US005236224A

United States Patent [19]

Anderson et al.

[11] Patent Number: 5,236,224

[45] Date of Patent: Aug. 17, 1993

[54] WALKER ATTACHMENT FOR IN-LINE SKATES

[76] Inventors: James D. Anderson; James E. Anderson; John S. Anderson, all of 338 E. Mariposa St., Phoenix, Ariz. 85012

[21] Appl. No.: 965,177

[22] Filed: Oct. 23, 1992

[51] Int. Cl.[5] ..... A63C 3/00

[52] U.S. Cl. ..... 280/825; 36/7.1 R; 36/15; 36/115; 280/11.22

[58] Field of Search ..... 36/7.1 R, 7.3, 15, 100, 36/101, 115, 135, 132; 280/825, 11.22, 11.23, 11.19

[56] References Cited

U.S. PATENT DOCUMENTS

| | | | |
|---|---|---|---|
| 30,627 | 11/1880 | Gibbs | 280/825 |
| D. 237,639 | 11/1975 | Melhechenko | 280/825 X |
| D. 242,938 | 1/1977 | Famolare, Jr. | 280/825 |
| 1,982,524 | 11/1934 | Kutchera | 280/825 |
| 3,015,492 | 1/1962 | Kesher et al. | 280/825 |
| 3,861,697 | 1/1975 | Dolce | 280/825 |
| 4,355,474 | 10/1982 | Grim | 280/825 X |
| 4,364,187 | 12/1982 | Melendez | 280/825 |
| 4,413,842 | 11/1983 | Loredo | 280/825 |
| 5,183,292 | 2/1993 | Ragin, III | 280/11.22 X |

OTHER PUBLICATIONS

Advertisement from "In-Line" Magazine, Oct. 1992 issue, Showing a set of rigid rollerguards.

*Primary Examiner*—Margaret A. Focarino
*Assistant Examiner*—Michael Mar
*Attorney, Agent, or Firm*—Schmeiser, Morelle & Watts

[57] ABSTRACT

The invention is a removable wheel cover for an in-line-type skate. The cover includes a front boot designed to inwardly receive the skate's front wheel. The cover also includes a rear boot designed to inwardly receive the skate's rear wheel. A pair of flexible, resilient straps connect together the two boots of the cover. When not in use, the cover can be folded into a small volume and easily stored within a user's pocket.

13 Claims, 2 Drawing Sheets

WALKER ATTACHMENT FOR IN-LINE SKATES

FIELD OF THE INVENTION

The invention is in the field of accessories for roller skates. More particularly, the invention is a removable cover designed to partially fit over the undercarriage of an in-line-type roller skate. The cover is used to facilitate walking while wearing skates.

BACKGROUND OF THE INVENTION

In recent times, in-line-type roller skates have become extremely popular. This type of roller skate is commonly identified as a ROLLERBLADE skate (ROLLERBLADE being a trademark of Rollerblade, Inc.) and is characterized by having three or more linearly-aligned wheels centrally located beneath each skate. The wheels are usually adjustably secured to a rigid undercarriage or frame that is fastened to the bottom portion of the shoe portion of the skate.

In-line roller skates suffer from a problem that has plagued roller skates since their inception. Namely, a roller skate is extremely unstable when the user has to walk on an uneven or irregular surface while wearing the skates. For example, when a user goes up or down stairs, he or she will normally tightly hold onto a handrail, if available, since the skates may inadvertently roll on the stair treads. Similar problems are encountered when skates are worn while walking on slippery surfaces in which, for example, a loose covering such as sand is present.

A number of other problems are also experienced with roller skates when they are worn while traversing certain types of surfaces. For example, some surfaces can be easily marked by the roller skate's wheels and therefore the user must remove his or her skates prior to stepping on the surface. Another example is when the surface can be damaged by the high forces exerted by the wheels of the skates due to their small contact area. This can cause carpeting to be torn or tiles to be irreparably dented.

In the prior art, a number of skate accessories have been developed in an attempt to overcome the above noted problems. For example, in 1880, Gibbs received patent No. 30,627 for a wooden member that had a top-located groove sized to receive the runner of an ice skate. In endeavors more particularly adapted to roller skates, Dolce (Pat No. 3,861,697), Loredo (Pat. No. 4,413,842), Melendez (Pat. No. 4,364,187) and Famolare, Jr. have all invented members that are removably secured to the bottom of a roller skate. However, all of the prior art deals with apparatus specifically designed for roller skates that have tandem wheels. None of the prior art is suitable for in-line roller skates. In addition, all of the prior art devices are bulky, complicated in design, relatively heavy and are time consuming to install.

SUMMARY OF THE INVENTION

The invention is a wheel cover for an in-line roller skate and is adapted to inwardly receive the bottom portions of the leading and trailing wheels of the skate. The cover will normally be used in pairs since a skater will use a cover for each skate. The cover includes a forward boot portion and a rearward boot portion. The two boot portions are connected by two flexible, resilient members.

The wheel cover is made of a rubber-like material and is of a unitary design. The preferred material is polyurethane which is inherently flexible and resilient. The use of this type of material enables the cover to be stretched to fit a range of different length skates. The cover can also be provided in different sizes to fit skates that are unusually long or short.

When the cover is not required, it can be folded upon itself into an extremely compact size and then placed within a user's pocket. The installation or removal of the cover is extremely simple and fast.

The cover's forward boot/boot portion is designed to fit around the skate's leading or forwardmost wheel. The boot has a flat bottom portion that underlies the wheel and provides a soft, non-slip contact surface between the wheel and the ground. The top of the boot fits over the wheel and contacts the frame to which the wheels are attached. In addition, the top portion of the boot includes a pull strap on each side to facilitate installation and removal of the cover on the skate.

The cover's rear boot/boot portion fits around the skate's rear wheel in a manner wherein the bottom portion of the boot fully underlies the wheel. The rear side of the boot is adapted to receive the brake member of the skate. The top of the boot fits onto the rear heel of the shoe portion of the skate.

To install a cover in accordance with the invention onto the bottom of an in-line type skate, one fully unfolds the cover and hooks the rear boot over the skate's rear wheel. The user then pulls the cover forwardly and stretches it over the bottom of the skate until the forward boot is proximate the skate's forward wheel. The user then grasps the forward boot's pull straps and pulls it over the skate's front wheel until the wheel is fully received within the boot. The user releases the pull straps, and the cover then snugly fits into place due to its inherent resiliency. The user can then walk around while wearing the skate since the cover underlies the skate's forward and rearward wheels and prevents any rolling movement of the wheels while also providing a non-slip contact surface between the skate and the ground. To remove the cover from the skate, the above procedure is followed in reverse.

DETAILED DESCRIPTION OF THE DRAWINGS

Figure 1:
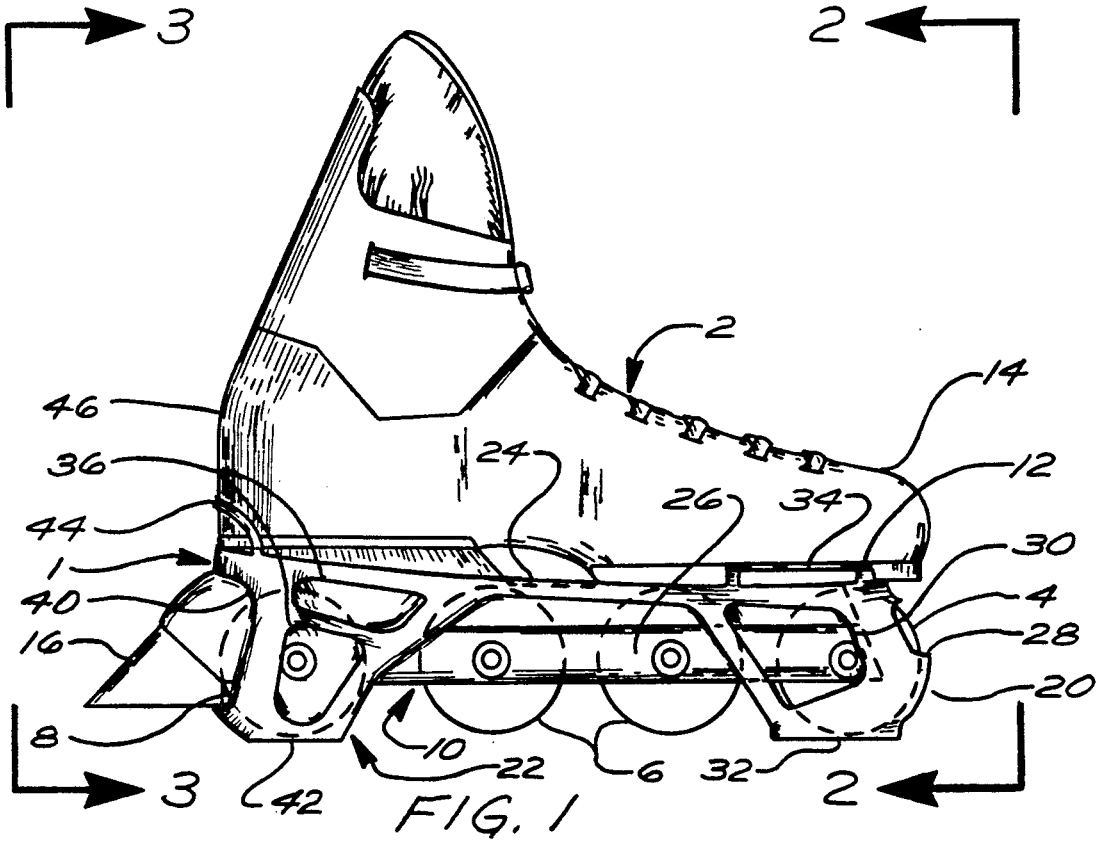
FIG. 1 is a side view of an in-line skate that includes a wheel cover in accordance with the invention.

Referring now to the drawings in greater detail, wherein like reference characters refer to like parts throughout the several figures, there is shown by the numeral 1 a wheel cover in accordance with the invention.

In FIG. 1, the cover 1 is shown secured to a typical in-line-type skate 2. The skate has a leading or forward wheel 4, two intermediary wheels 6 and a trailing or rearward wheel 8. The wheels are secured to a rigid frame 10 that is itself secured to the bottom 12 of the shoe portion 14 of the skate. A brake member 16 is also secured to the frame and is located behind the trailing wheel.

The cover 1 is made of a unitary piece of polyurethane material that is both flexible and resilient. The cover is preferably fashioned using a molding process. Other manufacturing processes and materials may be used however, the end product should have a degree of flexibility and resiliency that enables the installation of the cover as will be described.

The cover is composed of a front boot portion 20, a rear boot portion 22 and two members 24 that extend between and connect the two boot portions. When in place on a skate, the cover is located predominantly beneath the skate with the two connecting members 24 located above the side bars 26 of the skate frame 10.

Figure 2:
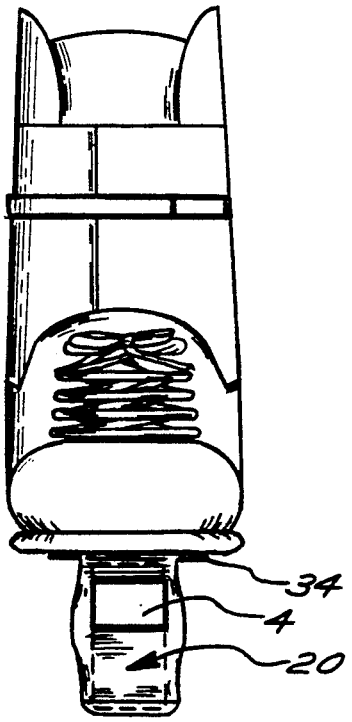
FIG. 2 is a front view of the skate and cover shown in FIG. 1.
Figure 5:
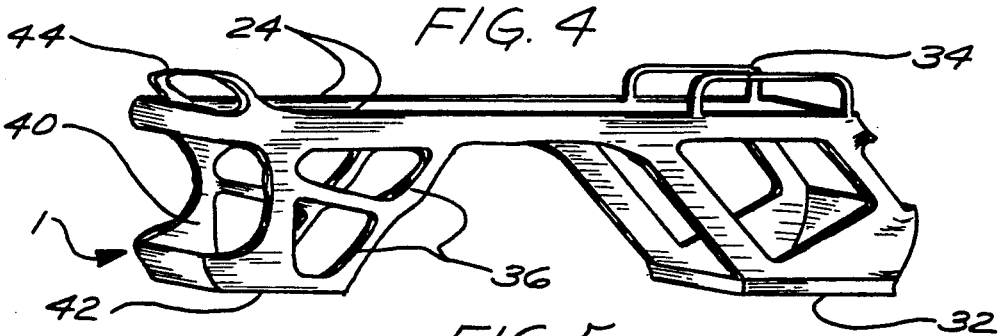
FIG. 5 is a perspective view of a wheel cover in accordance with the invention shown prior to its installation on a skate.

The front boot 20 is cup-shaped and is designed to fit over the front, sides, bottom and part of the top of the skate's front wheel. The front of the boot is shown in FIG. 2. The boot also includes a front cut-out/opening 28 and two side cut-outs/openings 30. Alternatively, the front cut-out may be horizontally divided (not shown) into an upper and lower cut-out. The cut-outs reduce the weight and bulk of the cover. The bottom of the boot has a flat surface 32 that is designed to completely underlie the skate's leading wheel. Located and secured to opposite top side edges of the boot are two pull-straps 34 (note FIG. 5).

Figure 3:
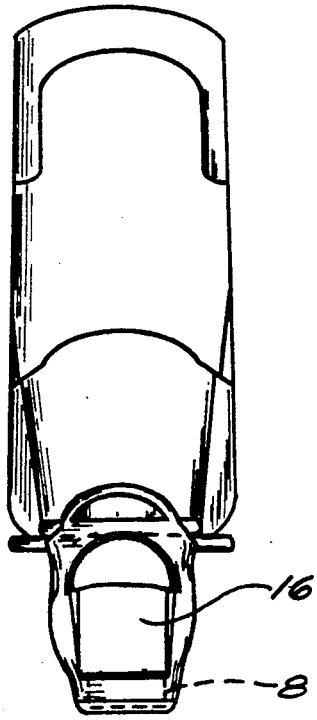
FIG. 3 is a rear view of the skate and cover shown in FIG. 1.
Figure 4:
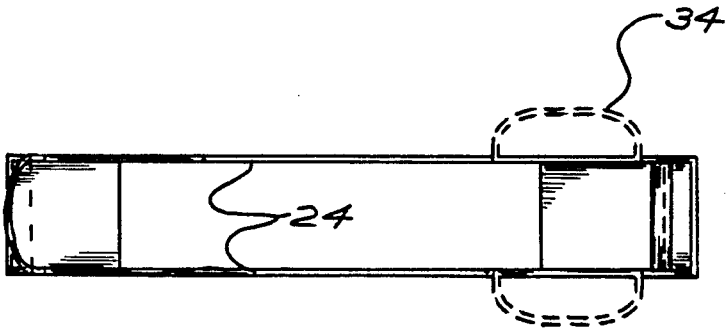
FIG. 4 is a top view of just the cover shown in FIG. 1.

The rear boot 22 of the cover is designed to fit over the sides and bottom of the skate's trailing wheel 8. A rear view of boot 22 is shown in FIG. 3. The rear boot has four side cutouts 36 and a rear cut-out 40. As noted previously, the use of cut-outs reduces the bulk and weight of the cover. The rear cut-out 40 additionally serves the function of allowing the skate's brake 16 to extend through the cover. The rear boot also has a flat bottom surface 42 that completely underlies the skate's trailing wheel. Located at the top rear of the boot is a strap 44 that is designed to engage the heel 46 of the skate's shoe portion 14.

Connecting members 24 connect the top right and left corners of the cover's front and rear boots. As noted previously, when the cover is in place on a skate, the connecting members will be located above the side bars of the frame 10. By locating the connecting members above the frame sidebars, they are in a somewhat protected area where they will not be subject to damage through contact with the wearer's other skate or with any other relatively sharp or pointed objects that the wearer may encounter when walking while wearing the skates. In this manner, portions of the cover that are normally subject to relatively high degrees of tension when located on the skate are relatively protected.

Figure 6:
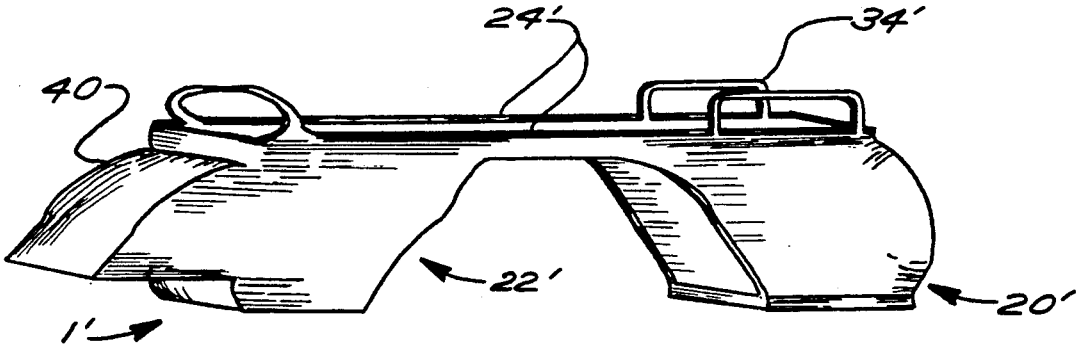
FIG. 6 is a perspective view of a second embodiment of a wheel cover in accordance with the invention shown prior to its installation on a skate.

FIG. 6 shows a second embodiment of a cover 1'. The cover is basically identical to the primary embodiment except that it does not have any of the cut-outs 28, 30, 36 and 40 and the rear boot 22' has been modified to include an outwardly extending sock portion 40. The sock is designed to inwardly receive the skate's brake member 16.

Figure 7:
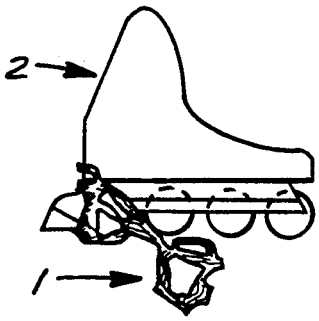
FIGS. 7–9 are generalized views in sequence showing the installation of a wheel cover on an in-line skate.
Figure 8:
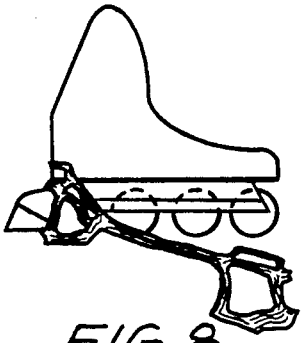
Figure 9:
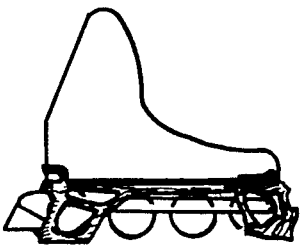

In FIGS. 7–9, the installation of a cover on an in-line-type skate is detailed.

FIG. 7 shows the first step for installation of the cover. The user unfolds the cover from its stored condition and places the cover's rear boot 22 around the skate's trailing wheel 8.

The user then grasps the two pull-straps 34 attached to the cover's front boot 20 and stretches the cover in a forward direction (shown in FIGS. 8 and 9). The material and design of the connecting members allows them to stretch up to approximately four inches.

The front boot is pulled forwardly until it is at least partially located in front of the skate's front wheel 4. Due to the resilient nature of the material, the entire cover can be stretched. During the installation, the majority of the lengthening of the cover will be localized in the connecting members 24.

The resiliency of the cover's boots is mostly taken advantage of when the boot is placed onto the particular wheel. The boot will be sized to very snugly fit the wheel and therefore a stretching action of the boot is often required during its initial placement on the wheel. Once in place, the boot tightly hugs the wheel and frame and prevents the wheel from rolling. This action is aided by the connecting members linking the two boots together and thereby substantially preventing the boots from any independent movement.

Once the cover's front boot has been pulled at least partially past the front wheel of the skate, the user slowly releases the pull-straps and the resilient nature of the cover causes the front boot to move snugly onto the front wheel of the skate and to come to rest in the position shown in FIG. 1.

Once in place, the cover completely underlies the front and rear wheels of the skate. It should be noted that the cover does not underlie any of the intermediary wheels. When a user walks with the cover on the skate, the skate's intermediary wheels will hardly, if at all, contact the ground and therefore do not require any covering. By designing the cover so that it does not have to act on the intermediary wheels, the size and weight of the cover can be minimized.

To remove the cover from the skate, the user basically reverses the above donning procedure. Due to the low bulk and flexibility of the cover, the removed cover can be crumpled or folded into a small volume and then placed within the user's pocket.

When installed on an in-line skate, the cover prevents the front and rear wheels of the skate from rolling, and also provides a soft, non-marking and slip-resistant contact surface between the skate and the ground. The cover is inexpensive to manufacture, can be compactly stored and is easy to install and remove.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A cover for an in-line roller skate of the type having at least three wheels that are linearly aligned, said cover comprising:

a first boot portion sized to inwardly receive a leading wheel of an in-line type skate, said boot portion having a flat bottom surface sized to completely cover a bottom surface of said wheel and further having a portion that connects a top rear portion of the boot to a bottom rear portion of the boot and having side surfaces that are sized to cover opposite top side portions of said wheel, said first boot further having a first pull-on strap and a second pull-on strap, each of said pull-on straps being located on and secured to an opposite top edge of said first boot and are adapted to contact protruding portions located on respective sides of a roller skate;

a second boot portion sized to inwardly receive a trailing wheel of an in-line type skate, said second boot portion having a flat bottom surface sized to completely cover a bottom surface of said wheel and further having a portion that connects a top front portion of the boot to a bottom front portion of the boot, said second boot portion further comprising side surfaces that are sized to overlie opposite top side portions of said wheel; and a resilient connecting means for connecting said first boot portion to said second boot portion wherein said connecting means is attached to upper portions of each of said first and second boot portions and wherein said first boot, said second boot, and said connecting means are made of a single, unitary piece of resilient material.

2. A cover for an in-line roller skate wherein said in-line skate has at least three linearly aligned wheels including a leading wheel located proximate a front portion of the skate, a trailing wheel located proximate a rear portion of the skate and at least one intermediary wheel located between the leading and trailing wheels, said wheels being rotatably attached to a frame that underlies an upper portion of the skate, said cover comprising:

a first boot sized to inwardly receive a single one of said wheels, said boot being open along a top portion thereof and having a flat bottom surface wherein when a wheel of an in-line skate is within the boot, the bottom surface of the boot will underlie said wheel, said first boot further having a first pull-on strap and a second pull-on strap, each of said pull-on straps being located on and secured to an opposite top edge of said first boot and are adapted to contact protruding portions located on respective sides of a roller skate;

a second boot sized to inwardly receive a single one of said wheels, said boot being open along a top portion thereof and having a flat bottom surface wherein when a wheel of an in-line skate is within the boot, the bottom surface of the boot will underlie said wheel; and a resilient connecting means that extends between and connects the first and second boots, wherein said first boot, said second boot, and said connecting means are made of a single, unitary piece of resilient material.

3. The cover of claim 2 wherein the connecting means comprises two resilient straps wherein each strap extends between a top portion of the first boot and a top portion of the second boot and wherein each of said straps is attached to an opposite side of each of said boots.

4. The cover of claim 2 wherein each pull-on strap forms an arch above said first boot and defines an aperture between an inner surface of the strap and the to edge of the first boot.

5. The cover of claim 2 wherein the second boot has an upwardly extending portion designed to fit against a heel portion of an in-line skate.

6. The cover of claim 2 wherein the second boot has a rear aperture sized to receive a brake member of an in line skate.

7. The cover of claim 2 wherein the second boot has a rearwardly extending sock portion designed to inwardly receive a brake member of an in-line roller skate.

8. A combination of an in-line roller skate and a removable wheel cover for said roller skate, said combination comprising:

an in-line roller skate having at least three linearly aligned wheels including a leading wheel located proximate a front portion of the skate, a trailing wheel located proximate a rear portion of the skate and at least one intermediary wheel located between the leading and trailing wheels, said wheels being rotatably attached to a frame that underlies an upper portion of the skate; and, a wheel cover having a first boot sized .to inwardly receive the leading wheel of the skate, said first boot being open along a top portion thereof and having a flat bottom surface of a predetermined length wherein it can underlie the skate's leading wheel without underlying any intermediary wheel of the skate, said first boot further having a first pull-on strap and a second pull-on strap, each of said pull-on straps being located on and secured to an opposite top edge of said first boot and are adapted to contact protruding portions located on respective sides of a roller skate, said cover further including a second boot sized to inwardly receive the trailing wheel of the skate, said second boot being open along a top portion thereof a flat bottom surface designed to underlie the skate's trailing wheel without underlying any intermediary wheel of the skate, said cover also having a resilient connecting means that extends between and connects the first and second boots, wherein said first boot, said second boot, and said connecting means are made of a single, unitary piece of resilient material.

9. The cover of claim 8 wherein the connecting means comprises two resilient straps wherein each strap extends between a top portion of the first boot and a top portion of the second boot and wherein each of said straps is attached to an opposite side of each of said boots.

10. The cover of claim 8 wherein each pull-on strap forms an arch above said first boot and defines an aperture between an inner surface of the strap and the top edge of the first boot.

11. The cover of claim 8 wherein the second boot has an upwardly extending portion designed to fit against a heel portion of the skate.

12. The cover of claim 8 wherein the second boot has a rear aperture sized to receive a brake member of the skate.

13. The cover of claim 8 wherein the second boot has a rearwardly extending sock portion designed to inwardly receive a brake member of the skate.

* * * * *